United States Patent [19]

Sassler

[11] 4,330,125

[45] May 18, 1982

[54] APPARATUS FOR REDUCING TORQUE AND VIBRATION IN RACQUETS

[76] Inventor: Marvin L. Sassler, 56 Palmer Dr., Wayne, N.J. 07470

[21] Appl. No.: 180,412

[22] Filed: Aug. 22, 1980

[51] Int. Cl.[3] ..... A63B 49/04

[52] U.S. Cl. ..... 273/73 C

[58] Field of Search ..... 273/73 R, 73 C, 73 D, 273/73 F, 73 G, 73 H, 73 L, 170, 67 R, 29 R, 29 A

[56] References Cited

U.S. PATENT DOCUMENTS

| | | | |
|---|---|---|---|
| 1,558,507 | 10/1925 | Ryder | 273/73 L |
| 2,738,616 | 3/1956 | Windle | 273/DIG. 24 |
| 3,109,651 | 11/1963 | O'Donnell | 272/126 |
| 3,907,292 | 9/1975 | Moreland | 273/73 C |
| 4,057,250 | 11/1977 | Kuban | 273/73 R X |
| 4,177,990 | 12/1979 | Kajiwara | 273/73 C |

FOREIGN PATENT DOCUMENTS

| | | | |
|---|---|---|---|
| 151916 | 6/1953 | Australia | 273/73 L |
| 2106800 | 9/1971 | Fed. Rep. of Germany | 273/73 H |
| 2554267 | 6/1977 | Fed. Rep. of Germany | 273/73 C |
| 2721715 | 12/1977 | Fed. Rep. of Germany | 273/73 C |
| 2741741 | 3/1978 | Fed. Rep. of Germany | 273/73 C |
| 1260715 | 9/1963 | France | 273/73 D |
| 310566 | 5/1929 | United Kingdom | 273/73 C |

*Primary Examiner*—Richard J. Apley

*Attorney, Agent, or Firm*—Hopgood, Calimafde, Kalil, Blaustein & Judlowe

[57] ABSTRACT

A device for reducing torque and vibration caused by an off-center impact between a ball and the face of a racquet. The device includes tubular guide means located about the periphery of the racquet head. Mounted within the tubular guide means are a system of self-adjusting counterbalancing weights. Movement of the racquet by an off-center impact causes the counterbalancing weights to be displaced. The displacement of the weights offsets and balances the torque and vibration of the impact.

6 Claims, 4 Drawing Figures

APPARATUS FOR REDUCING TORQUE AND VIBRATION IN RACQUETS

BACKGROUND OF THE INVENTION

This invention relates to a device for simultaneously reducing torque and vibration caused by an off-center impact of a ball and the face of a racquet. More particularly, the invention is directed to a device for simultaneously reducing wrist and elbow strain and minimizing errors in the trajectory of the ball as it rebounds off the racquet face. The invention is suitable for use with all types of racquets and paddles used in various sports.

Conventional racquets normally comprise a racquet face of strings into which the ball to be hit impacts. These racquets include an elongated rod or shaft which is attached to the outer perimeter of the racquet head so as to provide a handle. Although the conventional racquet has in the past functioned satisfactorily when a ball hits the center of the racquet face, it inherently possesses a number of substantial drawbacks when a ball strikes the racquet face outside of the central axis of the racquet.

The greatest drawback of the conventional racquet is that it tends to rotate or twist when a ball strikes the racquet face off center, flattens out, reverses direction and is propelled from the face of the racquet. It is the off-center location of impact that produces forces which tend to rotate the racquet. Obviously, since the racquet face has a diameter which is greater than that of the handle, the torque applied to the wrist due to the off-center impact is magnified. This twisting force is normally transmitted from the racquet, through the wrist and forearm of the user to the elbow, thereby becoming the major contributory factor to the class of ailments known as "tennis elbow". Although the magnitude of the torsional force is dependent upon the mass and velocity of the ball and the displacement of the collision from the central or major axis of the racquet face, the conventional racquet construction in many instances hinders the performance of the racquet and the protection of the user from the stresses induced by off-center impacts.

Another problem encountered when utilizing the conventional racquet is the creation of transverse vibrational motion. It should be noted that the production of transverse vibrations is normally not troublesome when a ball hits the racquet face on-axis or in the center of the "sweet spot". However, when a ball hits the racquet face off-center, complex torsional modes of vibration are produced, substantially inducing stress on the wrist and elbow of the user.

The present invention has resolved the above encountered problems by providing a system of self-adjusting counterbalancing weights, thereby substantially reducing the torsional force and vibrations produced by off-center impacts. The invention further provides a counterbalancing system which may be incorporated into new racquet heads or supplied as an adjunct device which may be added to existing racquet heads, thereby providing maximum performance of the racquet and protection of the user from the stresses induced by off-center impacts.

Accordingly, it is an object of the present invention to provide an apparatus for simultaneously reducing torsional force and vibrations caused by off-center impacts between a ball and the face of a racquet.

It is a further object of the present invention to reduce wrist and elbow strain caused by conventional racquets such that the torsional force applied to the wrist and transmitted to the elbow due to the off-center impact is minimized.

It is another object of the present invention to minimize errors in the trajectory of the ball as it rebounds off the racquet face.

Other objects and various further features of novelty will be pointed out and will occur to those skilled in the art from the following specification when taken in conjunction with the accompanying drawings.

SUMMARY OF THE INVENTION

The invention is directed to an apparatus for simultaneously reducing torsional force and vibrations produced by off-center impacts in racquets which include a tubular guide means, and counterbalancing means. The tubular guide means, which may be bonded to or incorporated into the racquet head, includes a substantially cylindrical tube which contains therein a counterbalancing means. The counterbalancing means comprises a system of self-adjusting weights which are confined within the tubular guide means. In the case of use of the invention with existing racquet heads, the invention further includes means to attach the guide tube to the racquet head.

DESCRIPTION OF THE DRAWINGS

For a fuller understanding of the invention, reference is had to the following description taken in connection with the accompanying drawings of the preferred embodiment in which.

DESCRIPTION OF THE PREFERRED EMBODIMENTS

The device of the present invention comprises a tubular guide means, a stabilizing means, and means for attachment to a racquet. The components of the invention cooperate with each other to simultaneously reduce torsional force and transverse vibration produced by an off-center impact of the ball on the racquet. Note that although the invention is illustrated herein in terms of use with a tennis racquet, it should be understood that the device may be adopted for use with any type of racquet or paddle used in sports such as badminton, squash, racquetball, paddleball, platform tennis, etc.

Figure 1:
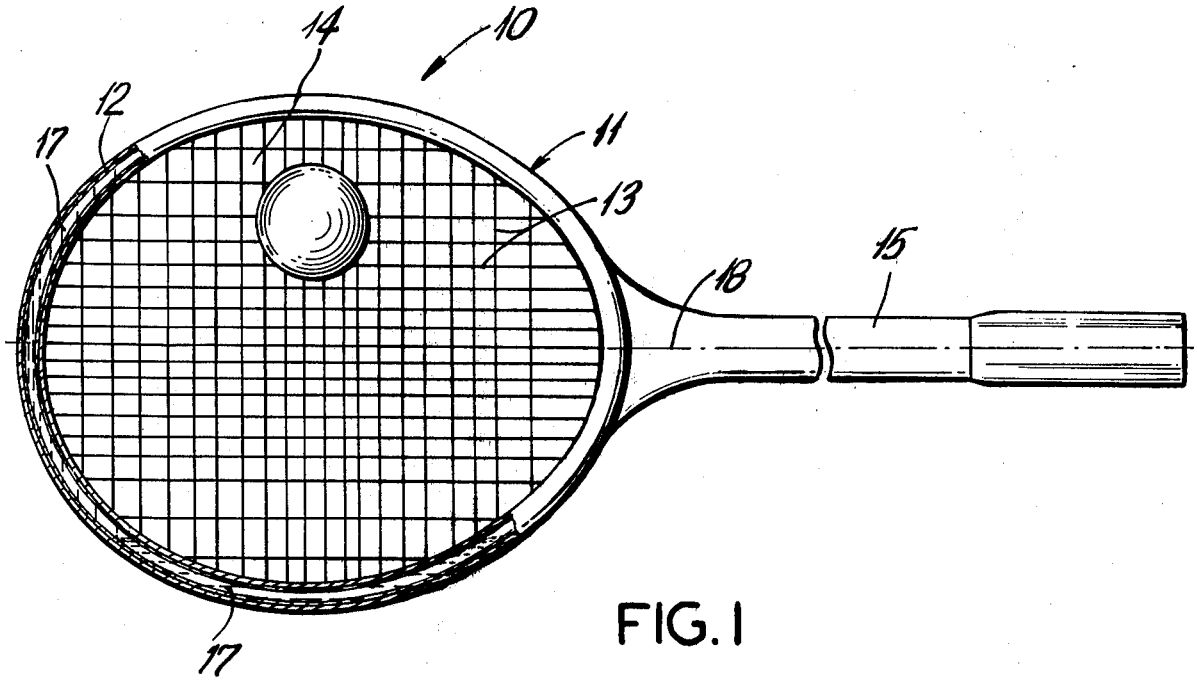
FIG. 1 is a partial sectional view of the racquet and stabilizing system of the present invention depicting the relative position of the counterbalancing weight before and after an off-center impact.

Referring now more particularly to the accompanying drawings attention is first directed to FIG. 1, wherein the device of the present invention is shown as an integral part of a racquet designated generally by reference number 10. More specifically, racquet 10 comprises a racquet head 11 which includes a tube 12 which is either bonded to or mounted in an interior chamber of racquet head 11. Tube 12 may either be a flexible plastic tube or a rigid tube formed from metal. Racquet head 11 further includes a nylon or other suitable stringing 13 which is stretched within the oval cavity 14 of racquet head 11. Racquet 10 is also provided with elongated shaft 15 which is attached to the outer perimeter of racquet head 11 so as to provide a handle means.

Figure 2:
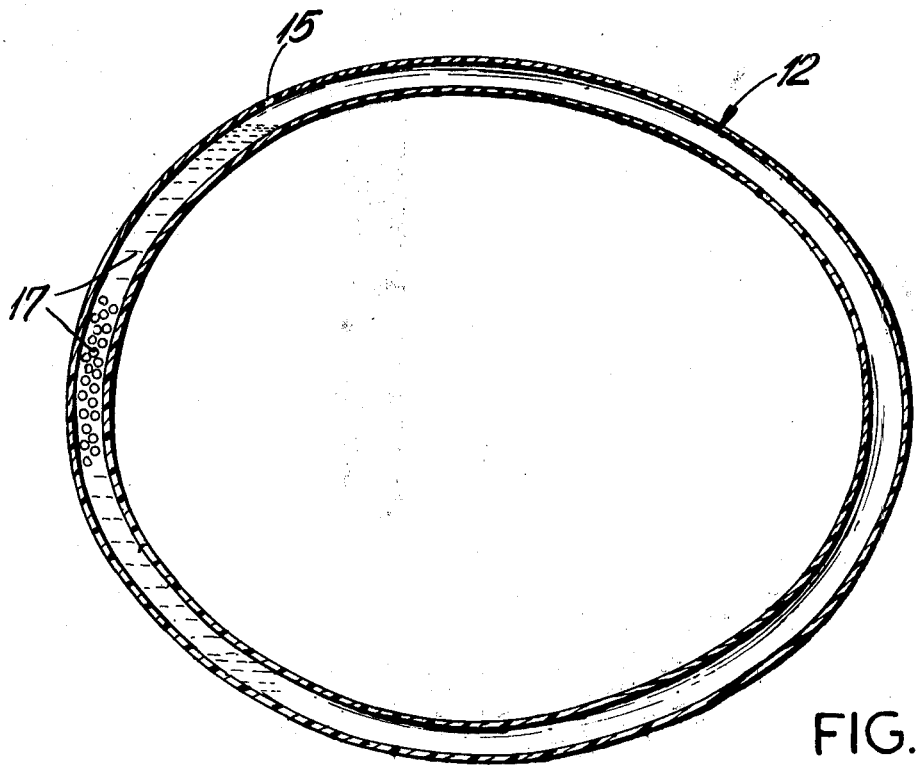
FIG. 2 is an enlarged sectional view of the tubular guide means of the present invention.
Figure 4:
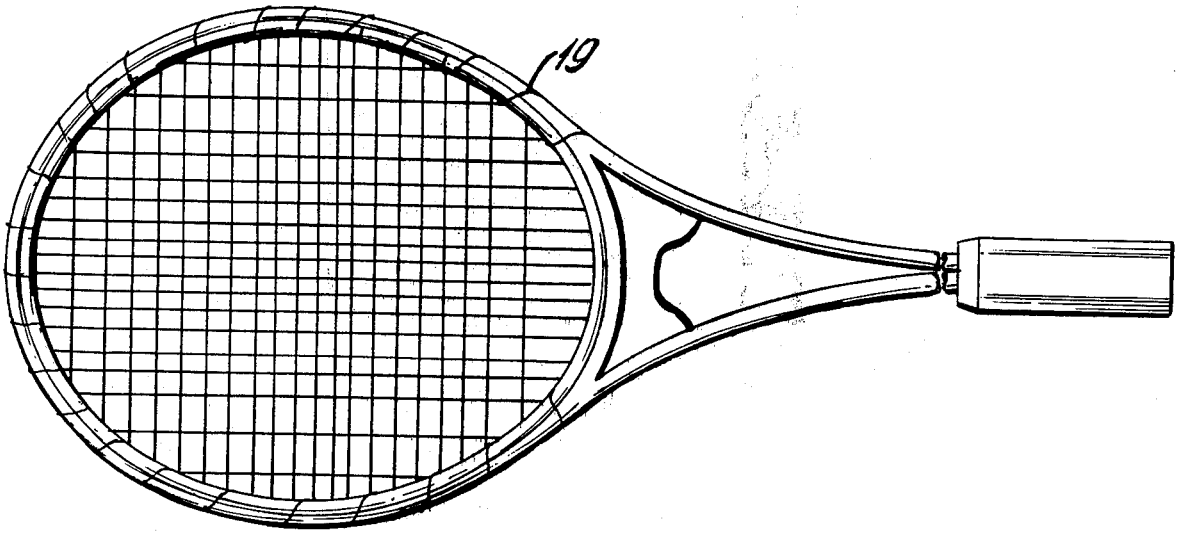
FIG. 4 is a front view of the stabilizing system and attachment means for use with an existing racquet head.

As can better be seen from FIG. 2, tube 12 is provided with an opening 15 to permit the entry of counterbalancing fluid 17 or weights which are placed within tube 12 to partially fill same. The counterbalancing weights of the present invention may be in the form of a fluid or small metallic spheres. For simplicity, the present discussion will be confined to the consideration of a fluid as the weight rather than the small metallic spheres. Referring again to FIG. 1, subsequent to the partial filling of tube 12 with counterbalancing fluid 17, tube 12 is sealed so as to permit fluid 17 to displace itself symmetrically about the major axis 18 of racquet 10 as it is swung. Where the invention is to be mounted in an interior chamber of racquet head 11, it is preferred that racquet head 11 be designed for minimum mass and inertia, with counterbalancing fluid 17 providing an optimum fraction of the final racquet weight. Where the invention is to be used with an existing racquet, attachment means 19 is utilized as seen in FIG. 4. Attachment means 19 may be a light-weight nylon or stainless steel filament.

The operation of the present invention will now be described in detail. When racquet 10 is swung, counterbalancing fluid 17 displaces itself symmetrically about axis 18 of racquet 10 to the top of head 11. An off-center impact between the ball and stringing 13 produces a torsional force which causes rotation of racquet 10 about axis 18. The rotational velocity about axis 18 is dependent upon the mass and velocity of the ball and the distance of the impact from axis 18. The rotation of racquet 10 causes counterbalancing fluid 17 to flow toward the upper or lower edge of racquet 10, the direction of motion of fluid 17 being dependent upon the position of the off-center impact. As seen in FIG. 1, an impact above major axis 18 causes counterbalancing fluid 17 to flow toward the lower edge of racquet head 11. Similarly, an impact below major axis 18 causes counterbalancing fluid 17 to flow toward the upper edge of racquet head 11. The movement of fluid mass 17 away from major axis 18 results in a decrease in the rotational velocity and torsional impulse produced by the off-center impact. The torsional force is impulsive in nature and occurs when a ball strikes stringing 13, flattens out, reverses direction and rebounds.

With certain types of racquet preparation prior to striking the ball, a looping motion may be used. This motion sets counterbalancing fluid 17 in a circular motion around the perimeter of racquet head 11, thereby creating a gyroscopic moment which tends to oppose the torsional impulse caused by an off-center impact. The torque produced by the off-center impact is then translated into a perpendicular force which is further divided by the ratio of the off-center impact distance to the distance between the impact point and the effective gripping point along shaft 15. The torsional impulse is thereby effectively reduced and translated into a motion perpendicular to the forearm extension and is thus relatively well isolated from the elbow.

Because much of the torsional energy produced by the off-center impact is translated into accelerating counterbalancing fluid 17, rather than being transmitted into the forearm tendons and elbow joint of the user, the decrease in rotational velocity of racquet 10 due to the off-center impact produces a stabilizing effect which reduces rotational angular displacement. The reduction in angular displacement provided by counterbalancing fluid 17 also reduces any error in trajectory of the returned ball and thus results in an effective improvement in control of off-center impacts.

Figure 3:
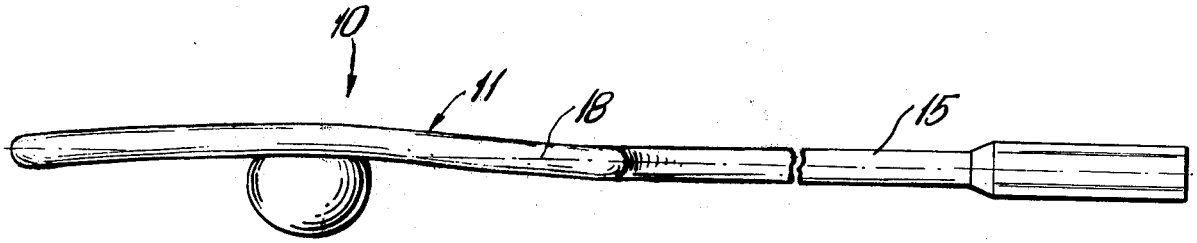
FIG. 3 is a side view of the racquet depicting the displacement of transverse vibration during an off-center impact.

In addition to the torsional energy produced, off-center impacts create complex modes of transverse vibrations as shown in FIG. 3. While the frequency of these vibrations is determined by the natural frequency of racquet 10, the amplitude is dependent upon the point at which the ball strikes stringing 13. As the movement of counterbalancing fluid 17 away from major axis 18 results in a decrease in the rotational velocity, fluid 17 simultaneously absorbs the vibrational motion of racquet 10 since counterbalancing fluid 17 flows to that region where vibration is the greatest. Counterbalancing fluid 17 will absorb the greatest amount of vibrational energy at this point.

In certain instances, it may be desirable to provide a reservoir for the counterbalancing fluid. The reservoir should be preferably located in the handle portion in order to minimize the head weight in certain positions of the racquet.

Although the present invention has been described in conjunction with preferred embodiments, it is to be understood that modifications and variations may be resorted to without departing from the spirit and scope of the invention as those skilled in the art will readily understand. Such modifications and variations are considered to be within the purview and scope of the invention and appended claims.

What is claimed is:

1. A racquet comprising a head portion having a striking surface and a shaft portion having one end connected to said head portion and having a handle at the other end portion, said head portion including a continuous one-piece looped tubular guide means, said guide means being free from internal obstructions; weight means disposed within said guide means so as to be displacable along said guide means, said weight means being of sufficient magnitude and being free to move along and unobstructively throughout said guide means so as to counterbalance the torque and vibration produced by off-center impacts upon said striking surface.

2. The device as claimed in claim 1, wherein said weight means comprises liquid means.

3. The device as claimed in claim 1, wherein said weight means comprise small spheres.

4. The device as claimed in claim 1, further including means for attaching said guide means to the periphery of said head portion, said means for attaching include an elongated filament wound around the outer periphery of said head portion of said racquet so that said guide means may be attached to an existing racquet.

5. The device as claimed in claim 1, further including means for attaching said guide means to the periphery of said head portion, said means for attaching include a groove integral with said head portion of said racquet.

6. The device as claimed in claim 1 wherein said guide means constitutes the entire racquet head portion.

* * * * *